US011142006B2

(12) United States Patent
Hiruma

(10) Patent No.: US 11,142,006 B2
(45) Date of Patent: Oct. 12, 2021

(54) RECORDING DEVICE

(71) Applicant: SEIKO EPSON CORPORATION, Tokyo (JP)

(72) Inventor: Daisuke Hiruma, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/795,363

(22) Filed: Feb. 19, 2020

(65) Prior Publication Data

US 2020/0269618 A1 Aug. 27, 2020

(30) Foreign Application Priority Data

Feb. 21, 2019 (JP) ..... JP2019-029605

(51) Int. Cl.

| | |
|---|---|
| ***B41J 19/20*** | (2006.01) |
| ***B41J 11/00*** | (2006.01) |
| ***B41J 25/00*** | (2006.01) |
| ***B41J 2/045*** | (2006.01) |
| *B41J 2/01* | (2006.01) |

(52) U.S. Cl.

CPC ..... *B41J 25/005* (2013.01); *B41J 2/04508* (2013.01); *B41J 11/008* (2013.01); *B41J 19/202* (2013.01); *B41J 19/207* (2013.01); *B41J 2/01* (2013.01)

(58) Field of Classification Search

CPC .... B41J 25/005; B41J 2/04508; B41J 19/202; B41J 19/207; B41J 2/01; B41J 11/008

See application file for complete search history.

(56) References Cited

U.S. PATENT DOCUMENTS

| | | | | |
|---|---|---|---|---|
| 5,134,779 | A * | 8/1992 | Sprenger | G01D 9/40 33/1 M |
| 2007/0024659 | A1* | 2/2007 | Grosse | B41J 19/202 347/19 |
| 2007/0146408 | A1 | 6/2007 | Tamaki et al. | |
| 2012/0182336 | A1 | 7/2012 | Itoh et al. | |
| 2014/0064816 | A1* | 3/2014 | Liggett | B41J 19/207 400/319 |

FOREIGN PATENT DOCUMENTS

| | | |
|---|---|---|
| JP | 2002-054918 | 2/2002 |
| JP | 2007-176117 | 7/2007 |
| JP | 2011-042087 | 3/2011 |

* cited by examiner

*Primary Examiner* — Yaovi M Ameh

(74) *Attorney, Agent, or Firm* — Workman Nydegger

(57) ABSTRACT

A recording device includes a medium support portion, a recording head configured to eject a liquid toward a medium supported by the medium support portion, a gantry that includes the recording head and is configured to move relative to the medium support portion in a Y-axis direction, a first linear scale attached to a first attachment member, a first encoder configured to read markings of the first linear scale while moving, together with the gantry, relative to the medium support portion in the Y-axis direction to detect a displacement of the gantry, and a length adjustment unit configured to adjust a length of the first linear scale attached to the first attachment member, by adjusting a tension in the Y-axis direction applied to the first linear scale.

8 Claims, 6 Drawing Sheets

RECORDING DEVICE

The present application is based on, and claims priority from JP Application Serial Number 2019-029605, filed Feb. 21, 2019, the disclosure of which is hereby incorporated by reference herein in its entirety.

BACKGROUND

1. Technical Field

The present disclosure relates to a recording device that performs recording on a medium.

2. Related Art

Recording devices that perform recording on a medium include devices that perform recording on a medium by ejecting ink (liquid) while a recording head is moved relative to the medium.

For example, JP-A-2011-42087 discloses a recording device that performs recording by moving in an X-axis direction while the recording head is moved in a Y-axis direction.

In the recording device described in JP-A-2011-42087, a printer head 20 serving as a recording head is provided on a Y bar 30 as a moving unit movable in the X-axis direction, and the recording device includes a linear encoder serving as a detector that detects a displacement of the moving unit in the X-axis direction as well as a linear scale read by the linear encoder. Note that in JP-A-2011-42087, the linear scale is denoted by reference numerals 50a, 50b, and the linear encoder is denoted by reference numerals 51a, 51b.

The linear scale, as illustrated in JP-A-2002-54918, for example, is fixed to an attachment member at a first end portion, which is one end portion of the linear scale, and pressed in a direction away from the first end portion by an elastic member, such as a spring, and attached to an attachment member at a second end portion, which is an end portion opposite to the first end portion, with tension applied to the linear scale. Note that in JP-A-2002-54918, the elastic member is a coil spring 40, and the attachment member is a guide rail 20.

In such an attachment structure of a linear scale as that described in JP-A-2002-54918, a length of the linear scale after attachment to the attachment members changes due to dimensional tolerances during manufacture of components such as the linear scale, the elastic member, and the attachment members, and thus variance in an accuracy of detection of a displacement of the moving unit may occur on a per device basis. In particular, in a large recording device, the length of the linear scale is also long, and thus the tolerances accumulate and the variation in accuracy readily increases.

SUMMARY

A recording device according to the present disclosure for solving the above-described problems includes a medium support portion configured to support a medium, an ejecting unit configured to eject a liquid toward a medium supported by the medium support portion, a moving unit that includes the ejecting unit and is configured to move relative to the medium support portion in a first axial direction, at least one linear scale provided with markings formed in the first axial direction, a detector configured to read the markings of the at least one linear scale while moving, together with the moving unit, relative to the medium support portion in the first axial direction to detect a displacement of the moving unit, and a length adjustment unit configured to adjust a length of the linear scale in the first axial direction, by adjusting a tension in the first axial direction applied to the at least one linear scale.

DESCRIPTION OF EXEMPLARY EMBODIMENTS

Figure 1:
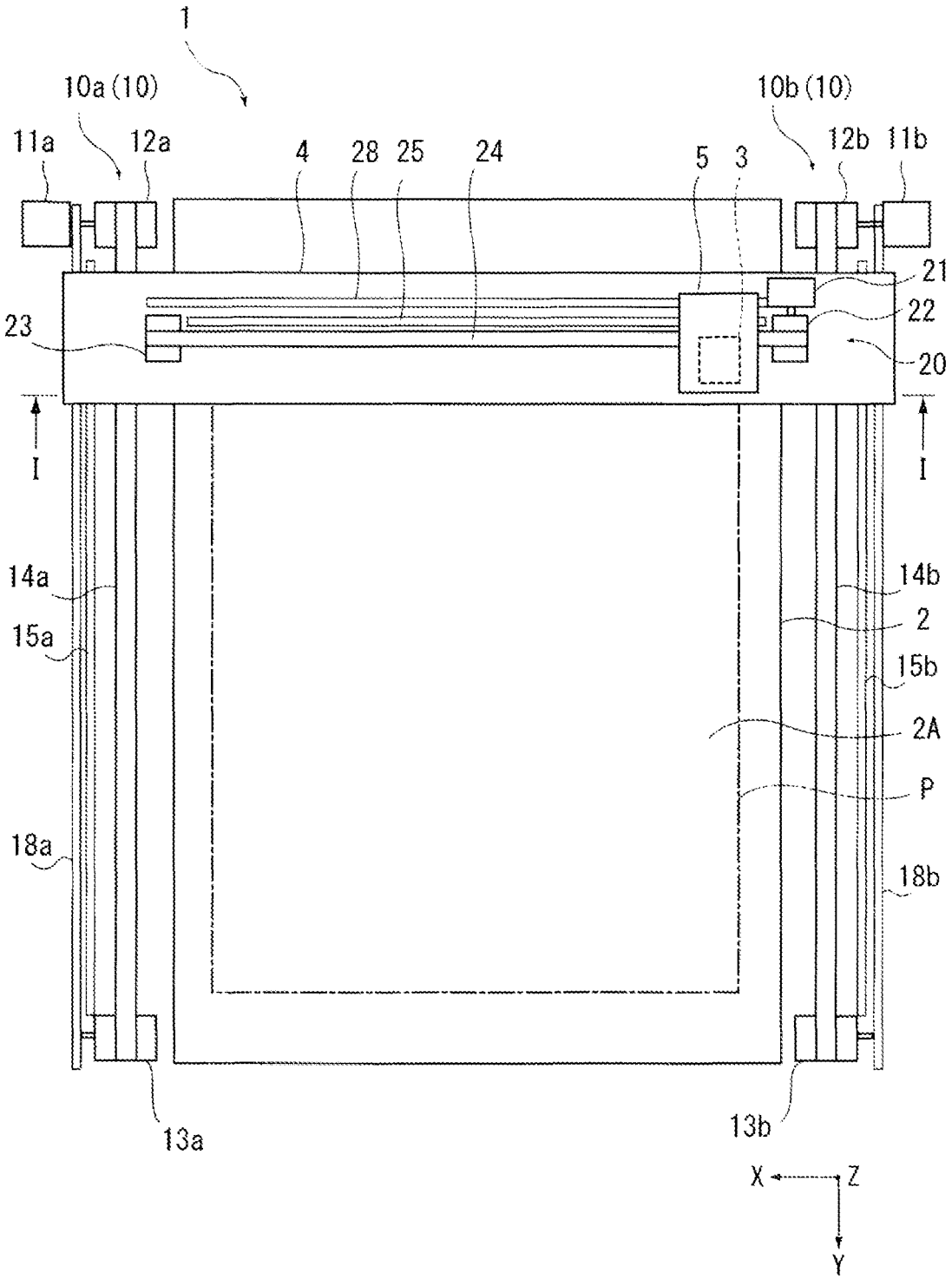
FIG. 1 is a schematic plan view of a recording device according to a first exemplary embodiment.

The present disclosure is schematically described below.

A recording device according to a first aspect includes a medium support portion configured to support a medium, an ejecting unit configured to eject a liquid toward a medium supported by the medium support portion, a moving unit that includes the ejecting unit and is configured to move relative to the medium support portion in a first axial direction, at least one linear scale provided with markings formed in the first axial direction and having tension applied in a direction along the first axial direction, a detector configured to read the markings of the at least one linear scale while moving, together with the moving unit, relative to the medium support portion in the first axial direction to detect a displacement of the moving unit, and a length adjustment unit configured to adjust the tension to adjust a length of the linear scale in the first axial direction.

According to this aspect, the length of the linear scale in the first axial direction can be adjusted by the length adjustment unit configured to adjust the tension to adjust the length of the linear scale in the first axial direction. This makes it possible to adjust variations in the length of the linear scale in the first axial direction caused by dimensional tolerances of the linear scale and components and stabilize a detection accuracy of the detector.

According to a second aspect, in the first aspect, the at least one linear scale includes a first linear scale and a second linear scale, and the length adjustment unit is configured to adjust at least one of a length of the first linear scale and a length of the second linear scale.

When two linear scales are disposed in parallel with the one moving unit, a tilting of the moving unit relative to the X-axis can be suppressed by aligning phases of the two linear scales. However, when the lengths of the two linear scales after attachment to the device are different, there is a risk that the phases of the two linear scales will not align and the moving unit will become tilted.

According to this aspect, because the at least one linear scale includes the first linear scale and the second linear scale, and the length adjustment unit is configured to adjust at least one of the length of the first linear scale and the length of the second linear scale, at least one or both lengths of the first linear scale and the second linear scale can be adjusted to align the lengths of the first linear scale and the second linear scale. This makes it possible to align the phases of the first linear scale and the second linear scale and achieve stable movement of the moving unit.

According to a third aspect, in the first aspect or the second aspect, the recording device includes a fixing member provided fixed in position in the first axial direction, wherein a first end portion, that is one end portion in the first axial direction of the at least one linear scale, is attached to the fixing member, and a moving member provided movable in the first axial direction, wherein a second end portion, that is an end portion opposite to the first end portion in the first axial direction of the at least one linear scale, is attached to the moving member. The length adjustment unit is configured to adjust a position of the moving member in the first axial direction.

According to this aspect, it is possible to adjust the tension of the linear scale to adjust the length of the linear scale with a simplified configuration.

According to a fourth aspect, in the third aspect, the second end portion is attached to the moving member via an elastic member having elasticity in a direction along the first axial direction.

According to this aspect, because the second end portion is attached to the moving member via the elastic member having elasticity in a direction along the first axial direction, the adjustment of the tension of the linear scale can be carried out in a stable manner.

According to a fifth aspect, in the third aspect or the fourth aspect, at least one of the fixing member and the moving member is adjustable in position in a second axial direction intersecting with the first axial direction.

According to this aspect, it is possible to adjust the tilting of the linear scale.

According to a sixth aspect, in any one of the first to fifth aspects, the moving unit is a carriage configured to move in a width direction, as the first axial direction, extending along a short side of the medium support portion.

According to this aspect, in a recording device in which the moving unit is a carriage configured to move in a width direction, as the first axial direction, extending along the short side of the medium support portion, the same action and effects as those of any one of the first to fifth aspects are achieved.

According to a seventh aspect, in any one of the first to fifth aspects, the moving unit is a gantry configured to move in a length direction, as the first axial direction, extending along a long side of the medium support portion.

According to this aspect, in the recording device in which the moving unit is a gantry configured to move in the length direction, as the first axial direction, extending along a long side of the medium support portion, the same action and effects as those of any one of the first to fifth aspects are achieved.

According to an eighth aspect, in the sixth aspect, the recording device includes, when a direction intersecting with the first axial direction is a second axial direction, a gantry configured to move in a length direction, as the second axial direction, extending along a long side of the medium support portion, at least one second linear scale provided with markings formed in the second axial direction and having tension applied in a direction along the second axial direction, a second detector configured to read the markings of the at least one second linear scale while moving, together with the gantry, relative to the medium support portion in the second axial direction to detect a displacement of the gantry, and a second length adjustment unit configured to adjust the tension to adjust a length of the at least one second linear scale in the second axial direction.

According to this aspect, the length of the second linear scale in the second axial direction can be adjusted after attachment to the device by the second length adjustment unit configured to adjust the tension to adjust the length of the at least one second linear scale in the second axial direction. This makes it possible to adjust variations in the length of the second linear scale in the second axial direction after attachment to the device caused by dimensional tolerances of the second linear scale and components of the device, and stabilize a detection accuracy of the displacement of the gantry by the detector.

According to a ninth aspect, in the seventh aspect, the recording device includes, when a direction intersecting with the first axial direction is a second axial direction, a carriage configured to move in a width direction, as the second axial direction, extending along a short side of the medium support portion, at least one second linear scale provided with markings formed in the second axial direction and having tension applied in a direction along the second axial direction, a second detector configured to read the markings of the at least one second linear scale while moving, together with the carriage, relative to the medium support portion in the second axial direction to detect a displacement of the carriage, and a second length adjustment unit configured to adjust the tension to adjust a length of the at least one second linear scale in the second axial direction.

According to this aspect, the length of the second linear scale in the second axial direction can be adjusted after attachment to the device by the second length adjustment unit configured to adjust the tension to adjust the length of the at least one second linear scale in the second axial direction. This makes it possible to adjust variations in the length of the second linear scale in the second axial direction after attachment to the device caused by dimensional tolerances of the second linear scale and components of the device, and stabilize a detection accuracy of the displacement of the carriage by the detector.

First Exemplary Embodiment

A first exemplary embodiment of a recording device will be described below with reference to the drawings. In an X-Y-Z coordinate system illustrated in each of the drawings, an X-axis direction represents a device width direction, a Y-axis direction represents a device depth direction, and a Z-axis direction represents a device height direction.

Figure 2:
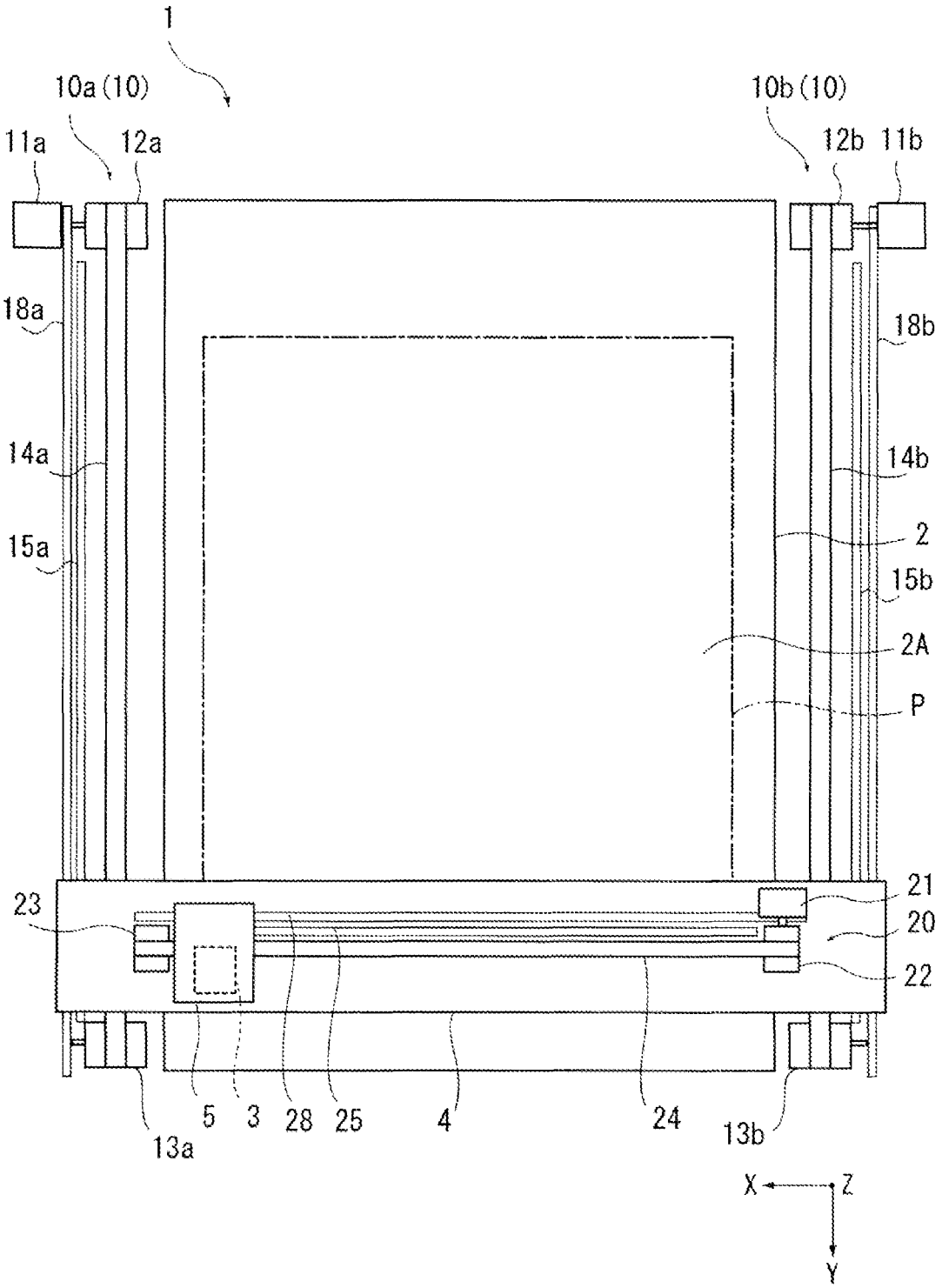
FIG. 2 is a schematic plan view of the recording device according to the first exemplary embodiment.

FIG. 1 and FIG. 2 are schematic plan views of a recording device 1 according to the present exemplary embodiment. The recording device 1 is an ink jet printer configured to eject liquid ink from a recording head 3 described later to form an image on a medium P.

As illustrated in FIG. 1 and FIG. 2, the recording device 1 includes a medium support portion 2 configured to support the medium P, the recording head 3 serving as an ejecting unit configured to eject ink toward the medium P supported by the medium support portion 2, and a gantry 4 that includes the recording head 3 and is movable in the Y-axis direction relative to the medium support portion 2. The gantry 4, given the Y-axis direction as a first axial direction, can be said to be a moving unit that moves relative to the medium support portion 2 in the first axial direction. The Y-axis direction is a length direction extending along a long side of the medium support portion 2 or the medium P.

Note that FIG. 1 illustrates the gantry 4 positioned in a home position at one end portion position in the Y-axis direction, and FIG. 2 illustrates the gantry 4 positioned at an end portion opposite to the home position.

While, in the present exemplary embodiment, the gantry 4 is configured to move relative to the medium support portion 2 fixed in position, the medium support portion 2 may be configured to move relative to the gantry 4 fixed in position.

The medium support portion 2 includes a support face 2A that supports the medium P. The recording device 1 is a so-called flatbed recording device that performs recording on the medium P supported by the medium support portion 2 and fixed in position. When the support face 2A is viewed in plan view, a length in the Y-axis direction of the medium support portion 2 is longer than a length in the X-axis direction of the medium support portion 2. That is, a side in the X-axis direction of the medium support portion 2 is a short side, and a side in the Y-axis direction of the medium support portion 2 is a long side. The length in the X-axis direction of the medium support portion 2 and the length in the Y-axis direction of the medium support portion 2 are designed taking into account a maximum value of a length in the X-axis direction of the medium P to be used and a maximum value of a length in the Y-axis direction of the medium P to be used.

Placement of the medium P onto the medium support portion 2 can be performed manually by a user or, for example, a configuration may be adopted in which a medium transport mechanism (not illustrated) capable of feeding the medium P having a roll shape is provided, and the medium P is fed onto the support face 2A before recording is started.

As the medium P, special paper for ink-jet recording, such as plain paper, pure paper, and glossy paper, and the like may be used. Other materials that can be used as the medium P include, for example, plastic films without a surface treatment for ink-jet printing applied, that is, without an ink absorption layer formed, as well as substrates such as paper having a plastic coating applied thereto and substrates having a plastic film bonded thereto. Such plastic materials include, but are not particularly limited to, for example, polyvinyl chloride, polyethylene terephthalate, polycarbonate, polystyrene, polyurethane, polyethylene, and polypropylene.

Further, a printable material such as fabric can by preferably used as the medium P. Fabrics includes natural fibers such as cotton, silk, and wool, chemical fibers such as nylon, or composite fibers of natural fibers and chemical fibers such as woven cloths, knit fabrics, and non-woven cloths.

As inks, for example, dye inks, pigment inks, and the like can be used. Further, an ultraviolet (UV) ink that cures by irradiation of ultraviolet light can be used. When the UV ink is used, the recording head 3 is provided with a UV light source (not illustrated) that cures the ink to fix the ink onto the medium P.

The recording head 3 is provided in a position facing a support region of the medium P in the medium support portion 2, and is capable of ejecting ink toward the support region. The recording device 1 of the present exemplary embodiment is capable of printing an image by moving the gantry 4 in the Y-axis direction and ejecting ink from the recording head 3 onto the transported medium P while moving a carriage 5 back-and-forth in the X-axis direction intersecting with the Y-axis direction.

FIG. 1 illustrates the carriage 5 positioned in a home position at one end position in the X-axis direction, and FIG. 2 illustrates the carriage 5 positioned at an end portion opposite to the home position. Note that the carriage 5, given the X-axis direction as the first axial direction, is a moving unit capable of moving relative to the medium support portion 2 in the first axial direction. The X-axis direction is a width direction extending along a short side of the medium support portion 2 or the medium P.

The recording device 1 includes a first movement mechanism 10 that moves the gantry 4 in the Y-axis direction, and a second movement mechanism 20 that moves the carriage 5 in the X-axis direction.

Movement Mechanism of Gantry and Carriage

Hereinafter, the first movement mechanism 10 and the second movement mechanism 20 will be described in order primarily with reference to FIG. 1 and FIG. 2.

The first movement mechanism 10 includes a first movement mechanism 10*a* and a first movement mechanism 10*b*, and the first movement mechanism 10*a* and the first movement mechanism 10*b* are provided sandwiching the medium support portion 2, one on each side, in front views of FIG. 1 and FIG. 2.

The first movement mechanism 10*a* includes a first motor 11*a*, which is a drive source, a first driving roller 12*a* rotationally driven by the first motor 11*a*, a first driven roller 13*a* driven and rotated by the rotation of the first driving roller 12*a*, a first belt 14 that is endless and wrapped around the first driving roller 12*a* and the first driven roller 13*a*, and a first linear scale 15*a* for detecting a displacement of the gantry 4.

The first motor 11*a*, the first driving roller 12*a*, the first driven roller 13*a*, and the first linear scale 15*a* are provided to a first frame 18*a* extending in the Y-axis direction.

The first linear scale 15*a* is a linear scale, is provided with markings formed in the Y-axis direction, and is attached to a first attachment member 41 (FIG. 6) described later and provided to the first frame 18*a* with tension applied in a direction along the Y-axis direction. Note that the Y-axis direction is a movement direction of the moving unit moved by the first movement mechanism 10*a* relative to the gantry 4, and is the first axial direction. In this case, the X-axis direction is the movement direction of the carriage 5 moved by a second movement mechanism 20*a*, and is a second axial direction intersecting with the first axial direction.

While a detailed description is omitted. The first movement mechanism 10*b* includes a second motor 11*b*, a second driving roller 12*b*, a second driven roller 13*b*, a second belt 14*b*, and a second linear scale 15*b* respectively corresponding to the first motor 11*a*, the first driving roller 12*a*, the first driven roller 13*a*, the first belt 14*a*, and the first linear scale 15*a* of the first movement mechanism 10*a*, and has the same configuration as that of the first movement mechanism 10*a*.

The second motor 11*b*, the second driving roller 12*b*, the second driven roller 13*b*, and the second linear scale 15*b* are provided to a second frame 18*b* extending in the Y-axis direction.

The second linear scale 15*b*, similar to the first linear scale 15*a*, is also a linear scale, is provided with markings formed in the Y-axis direction, and is attached to a second attachment member 41 (FIG. 6) described later and provided to the second frame 18*b* with tension applied in a direction along the Y-axis direction. The attachment configurations of the first linear scale 15*a* and the second linear scales 15*b* to the first attachment member 41 and the second attachment member 51 will be described later in detail.

Figure 4:
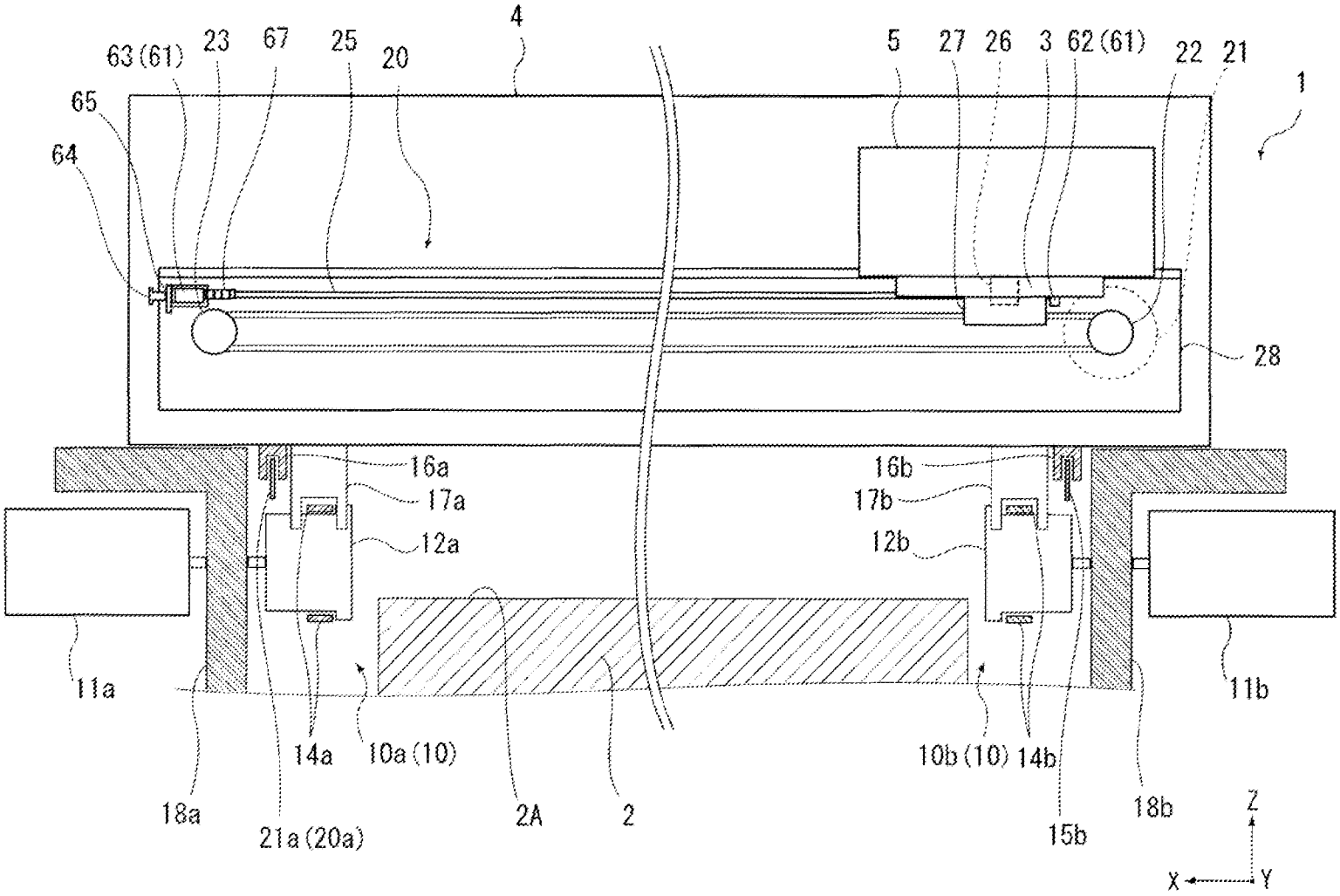
FIG. 4 is a cross-sectional view taken along line I-I in FIG. 1.

The gantry 4, as illustrated in FIG. 4, is attached to the first belt 14*a* and the second belts 14*b* via a first belt attachment portion 17*a* and a second belt attachment portion 17*b* provided to a lower portion of the gantry 4, and integrally moves with the first belt 14*a* and the second belt 14*b* rotated by the power of the first motor 11*a* and the second motor 11*b* to move in the Y-axis direction. That is, the first belt attachment portion 17*a* is a member for attaching the gantry 4 to the first belt 14*a*, and the second belt attachment portion 17*b* is a member for attaching the gantry 4 to the second belt 14*b*.

The lower portion of the gantry 4, as illustrated in FIG. 4, is provided with a first encoder 16*a* and a second encoder 16*b* that read the respective markings of the first linear scale 15*a* and the second linear scale 15*b*. The first encoder 16*a* and the second encoder 16*b* are detectors that read the markings of the first linear scale 15*a* and the second linear scale 15*b* while moving relative to the medium support portion 2 in the Y-axis direction together with the gantry 4 to detect the displacement of the gantry 4. More specifically, the configuration is such that position information of the gantry 4 and a movement velocity of the gantry 4 are calculated from the markings read by each encoder, and the displacement of the gantry 4 is then calculated.

Note that the first encoder 16*a* and the second encoder 16*b* need not have a function for calculating the position information of the gantry 4 and the movement velocity of the gantry 4 from the markings read by each encoder. For example, a configuration may be adopted in which the first encoder 16*a* and the second encoder 16*b* output a pulse corresponding to the position information of the gantry 4 to a control unit 30 described later, and the control unit 30 calculates the position of the gantry 4 and the movement velocity of the gantry 4 on the basis of the pulse.

The second movement mechanism 20, as illustrated in FIG. 1 and FIG. 2, includes a carriage motor 21, which is a drive source, a driving roller 22 rotationally driven by the carriage motor 21, a driven roller 23 driven and rotated by the rotation of the driving roller 22, a belt 24 that is endless and wrapped around the driving roller 22 and the driven roller 23, and a third linear scale 25 for detecting a displacement of the carriage 5.

The carriage motor 21, the driving roller 22, the driven roller 23, and the third linear scale 25 are provided to a third frame 28 extending in the X-axis direction.

The third linear scale 25 is a linear scale, is provided with markings formed in the X-axis direction, and is attached to a third attachment member 61 described later and provided to the third frame 28 with tension applied in a direction along the X-axis direction. Note that the X-axis direction is the first axial direction relative to the carriage 5 of the moving unit moved by the second movement mechanism 20*a*. In this case, the Y-axis direction is the movement direction of the gantry 4 moved by the first movement mechanism 10*a*, and is the second axial direction intersecting with the first axial direction. The first axial direction is the movement direction of the moving unit. The attachment configuration of the third linear scale 25 to the third attachment member 61 will be described later in detail.

The carriage 5, as illustrated in FIG. 4, is attached to the belt 24 via a carriage belt attachment portion 27, and integrally moves with the belt 24 rotated by the power of the carriage motor 21 to move in the X-axis direction.

The carriage 5, as illustrated in FIG. 4, is provided with a third encoder 26 that reads the markings of the third linear scale 25. The third encoder 26 is a detector that reads the markings of the third linear scale 25 while moving relative to the medium support portion 2 in the X-axis direction together with the carriage 5 to detect the displacement of the carriage 5. More specifically, the configuration is such that position information of the carriage 5 and a movement velocity of the carriage 5 are calculated from the markings read by the third encoder 26, and the displacement of the carriage 5 is then calculated.

Attachment of Linear Scales to Device

Figure 5:
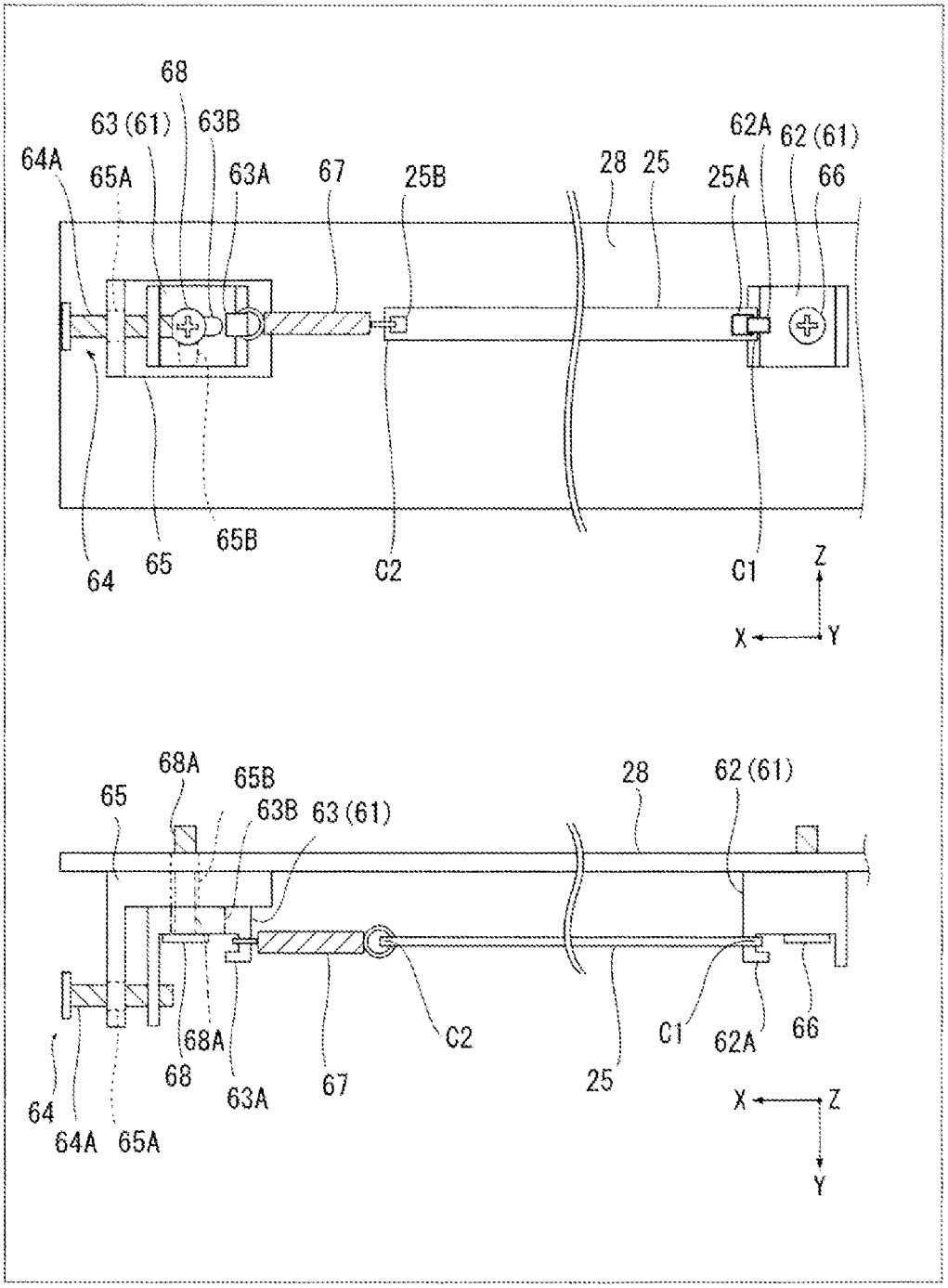
FIG. 5 is a diagram for explaining an attachment configuration of a third linear scale.

The attachment configurations of the first linear scale 15*a*, the second linear scale 15*b*, and the third linear scale 25 of the recording device 1 are described below. First, the third linear scale 25 corresponding to the carriage 5 will be described with reference to FIG. 5 as an example.

The third linear scale 25 is formed by a film such as a resin material. Printed markings are formed on the third linear scale 25 before attachment. The third linear scale 25 includes attachment holes 25A, 25B at end portions on both sides in the longitudinal direction (X-axis direction in FIG. 5). The attachment hole 25A is provided in a first end portion C1, which is one end portion of the third linear scale 25 in the X-axis direction. The first end portion C1 is an end portion of the third linear scale 25 in the −X direction. The attachment hole 25B is provided on a second end portion C2, which is an end portion opposite to the first end portion C1 in the X-axis direction. The second end portion C2 is an end portion of the third linear scale 25 in the +X direction.

The third attachment member 61 to which the third linear scale 25 is attached includes a fixing member 62 including a hook unit 62A that hooks onto the attachment hole 25A, and a moving member 63 including a hook unit 63A that attaches the second end portion C2 side. While the attachment hole 25B can be directly hooked onto the hook unit 63A, in the present exemplary embodiment, the second end portion C2 is attached to the hook unit 63A of the moving member 63 via a spring member 67 serving as an elastic member having elasticity in a direction along the X-axis direction.

The fixing member 62 and the moving member 63 are provided to the third frame 28. Note that the moving member 63 is provided to the third frame 28 via a bracket 65 described later.

As described above, the third linear scale 25 is attached to the third attachment member 61 with tension applied in the X-axis direction. Specifically, a spacing between the fixing member 62 and the moving member 63 respectively hooked onto the attachment holes 25A, 25B on both ends of the third linear scale 25 is set to a spacing at which tension is applied to the third linear scale 25.

Here, when the spacing between the fixed member 62 and the moving member 63 is set at a constant value for applying a predetermined tension to the third linear scale 25, a length of the third linear scale 25 after attachment to the third attachment member 61 may vary due to dimensional tolerances during manufacture of various components such as the third linear scale 25, the fixing member 62, and the moving member 63. This variation in the length of the third linear scale 25 affects an accuracy of detection of the displacement of the carriage 5.

In particular, when the recording device 1 is large, the length of each linear scale is also long, and thus the tolerances accumulate at the time of formation of the markings on the linear scale, for example, and the variation in accuracy readily increases. The recording device considered large in size includes a linear scale having a length of 2 m or greater, for example.

Therefore, the recording device 1 of the present exemplary embodiment is provided with a length adjustment unit 64 that adjusts the tension applied to the third linear scale 25 to adjust the length of the third linear scale 25 attached to the third attachment member 61.

Because the length of the third linear scale 25 after attachment to the third attachment member 61 can be adjusted by the length adjustment unit 64, variations in the length of the third linear scale 25 after attachment to the third attachment member 61 caused by dimensional tolerances of components can be adjusted and the detection accuracy of the third encoder 26, which is the corresponding encoder, can be stabilized.

The configuration for adjusting the length of the third linear scale 25 by the length adjustment unit 64 will now be described in more detail.

The fixing member 62 constituting the third attachment member 61 is provided fixed in position in the X-axis direction. The fixing member 62 is fixed to the third frame 28 by a fixing means 66, such as a screw, illustrated in FIG. 5.

Further, the fixing member 62 constituting the third attachment member 61 is provided movable in the X-axis direction. The moving member 63 is provided to the third frame 28 via the bracket 65. The bracket 65 is fixed in position in the X-axis direction relative to the third frame 28 by a screw member 68, for example. The screw member 68, as illustrated in the bottom view of FIG. 5, extends through the moving member 63, the bracket 65, and the third frame 28. A hole 65B provided in the bracket 65 has a size in the X-axis direction corresponding to that of a shaft portion 68A of the screw member 68, and regulates a movement of the bracket 65 in the X-axis direction. On the other hand, a hole 63B provided in the moving member 63 is formed as a long hole long in the X-axis direction and, even when the screw member 68 is inserted, the moving member 63 can move in the X-axis direction within a range of the long hole of the hole 63B.

Then, the length adjustment unit 64 is configured to adjust the position of the moving member 63 in the X-axis direction. The length adjustment unit 64 is formed as an adjustment screw that rotates the shaft portion 64A to adjust the position of the moving member 63 in the X-axis direction. The moving member 63 is provided fixed in position relative to the shaft portion 64A in the X-axis direction at a tip end of the shaft portion 64A. The bracket 65 is provided with a screw hole 65A including a thread groove (not illustrated) corresponding to threads of the length adjustment unit 64. As a result, by rotating the length adjustment unit 64, it is possible to move the length adjustment unit 64 relative to the bracket 65 in the X-axis direction, and thus move the moving member 63 in the X-axis direction.

With a configuration in which the length adjustment unit 64 adjusts the position of the moving member 63 in the X-axis direction as described above, it is possible to adjust the tension of the third linear scale 25 to adjust the length of the third linear scale 25 with a simple configuration.

Further, because the second end C2 of the third linear scale 25 is attached to the moving member 63 via the spring member 67, allowing the spring member 67 to absorb the displacement of the moving member 63, it is possible to more stably adjust the tension of the third linear scale 25 than when the third linear scale 25 is directly attached to the moving member 63.

The specific length adjustment of the third linear scale 25 can be performed as follows, for example.

First, the position of the carriage 5 in the home position (the position illustrated in FIG. 1) is measured by a high-precision position detection means such as a laser interferometer. A reading of the third linear scale 25 by the third encoder 26 at this time is zero.

Next, the carriage 5 is moved in the +X direction until the displacement of the carriage 5 detected by the laser interferometer is a predetermined distance (1 m, for example). After the movement of the carriage 5, the markings of the third linear scale 25 are read by the third encoder 26. The length of the third linear scale 25 is adjusted by the length adjustment unit 64 so that the reading of the third linear scale 25 by the third encoder 26 matches the displacement of the carriage 5 measured by the laser interferometer.

In the present exemplary embodiment, the moving member 63 is adjustable in position relative to the third attachment member 61 in the Y-axis direction or the Z-axis direction. For example, the position in the Y-axis direction relative to the third frame 28 of the bracket 65 can be adjusted using the screw member 68 illustrated in FIG. 5 as an adjustment screw. Further, the hole 65B in the bracket 65 into which the screw member 68 is inserted is, as illustrated in the upper drawing in FIG. 5, formed as a long hole long in the Z-axis direction, and the bracket 65 can be moved in the Z-axis direction within the range of the long hole of the hole 65B by a height adjustment mechanism (not illustrated), even when the screw member 68 is inserted.

By adjusting the position of the bracket 65, it is possible to adjust the position of the moving member 63 attached to the bracket 65 in the Y-axis direction or the Z-axis direction.

In addition to the X-axis direction, the moving member 63 can be adjustable in position in both the Y-axis direction and the Z-axis direction. However, a configuration may be adopted in which the moving member 63 is adjusted in position in only the X-axis direction and one of the Y-axis direction and the Z-axis direction. Note that a configuration may also be adopted in which the moving member 63 is adjusted in position in only the X-axis direction. In this case, a configuration may be adopted in which the length adjustment unit 64 and the moving member 63 are directly attached to the third frame 28 by, for example, bending an end portion of the third frame 28 that is in the +X direction, or the like. That is, a configuration may be adopted in which the bracket 65 is omitted.

Further, a configuration may be adopted in which the position of the fixing member 62, rather than the moving member 63, in the Y-axis direction or the Z-axis direction is adjusted. Further, a configuration may be adopted in which both the moving member 63 and the fixing member 62 are adjustable in position in the Y-axis direction or the Z-axis direction.

Note that when the X-axis direction, which is the extending direction of the third linear scale 25, is the first axial direction, the Y-axis direction can be said to be the second axial direction intersecting with the first axial direction. Further, the Z-axis direction can also be considered as the second axial direction intersecting with the first axial direction.

Figure 6:
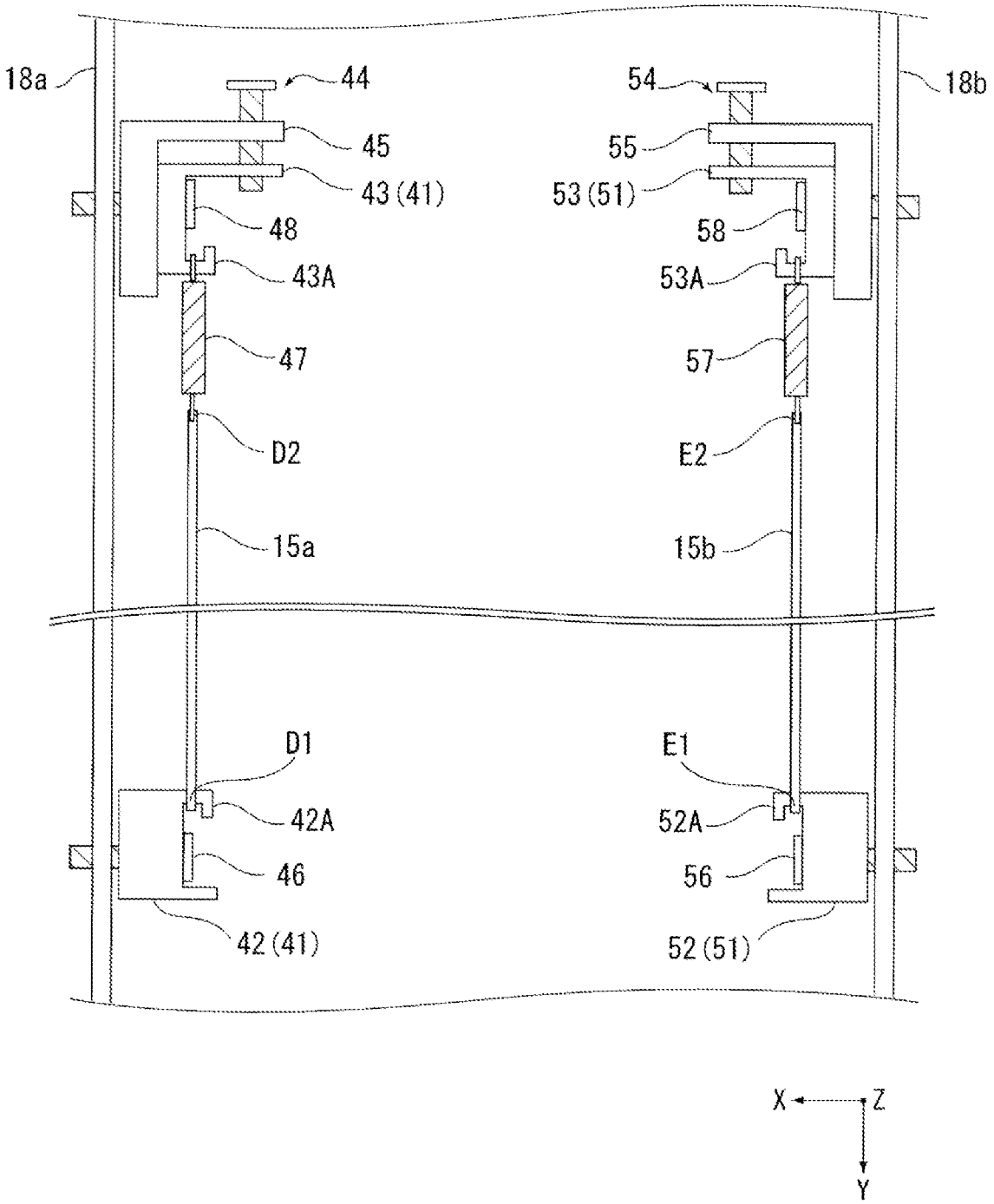
FIG. 6 is a diagram for explaining attachment configurations of a first linear scale and a second linear scale.

Next, the first linear scale 15*a* and the second linear scale 15*b* corresponding to the gantry 4 will be described with reference to FIG. 6. The first linear scale 15*a* and the second linear scale 15*b* are provided to the first frame 18*a* and the second frame 18*b* essentially by the same configuration as that of the third linear scale 25. The first linear scale 15*a* is provided to the first frame 18*a* via the first attachment member 41. The second linear scale 15*b* is provided to the second frame 18*b* via the second attachment member 51.

The first attachment member 41 to which the first linear scale 15*a* is attached includes a fixing member 42 provided fixed in position in the Y-axis direction, wherein a first end portion D1, that is one end portion in the Y-axis direction of the first linear scale 15*a*, is attached to the fixing member 42, and a moving member 43 provided movable in the Y-axis direction, wherein a second end portion D2, that is an end portion opposite to the first end portion in the first axial direction of the at least one linear scale 15*a*, is attached to the moving member 43.

The fixing member 42 includes a hook unit 42A that hooks onto the first end portion D1 of the first linear scale 15*a*. The fixing member 42 is fixed to the first frame 18*a* by a fixing means 46, such as a screw.

The moving member 42 includes a hook unit 43A that attaches the second end portion D2 of the first linear scale 15*a* via a spring member 47 serving as the elastic member.

The moving member 43 is provided to the first frame 18*a* via a bracket 45. The bracket 45 is fixed in position in the Y-axis direction relative to the third frame 28 by a screw member 68, for example.

Further, a length adjustment unit 44 is provided that adjusts the tension of the first linear scale 15*a* to adjust the length of the first linear scale 15*a* attached to the first attachment member 41, and is configured to adjust the position of the moving member 43 in the Y-axis direction.

While a detailed description is omitted, the second attachment member 51 that provides the second linear scale 15*b* to the second frame 18*b* includes the second attachment member 51, a fixing member 52, a moving member 53, a length adjustment unit 54, a bracket 55, a fixing means 56, a spring member 57, and a screw member 58 corresponding to the first attachment member 41, the fixing member 42, the moving member 43, the length adjustment unit 44, the bracket 45, the fixing means 46, the spring member 47, and the screw member 48 of the attachment configuration of the first linear scale 15*a*. The fixing member 52 includes a hook unit 52A to which a first end portion E1, which is an end portion of the second linear scale 15*b* in the +Y direction, is attached, and the moving member 53 includes a hook unit 53A to which a second end portion E2, which is an end portion of the second linear scale 15*b* in the −Y direction, is attached via the spring member 57.

When two linear scales, that is, the first linear scale 15*a* and the second linear scale 15*b*, are disposed relative to the gantry 4 in the same Y-axis direction, phases of the two linear scales align, making it possible to suppress tilting of the gantry 4 relative to the X-axis. However, when the lengths of the first linear scale 15*a* attached to the first attachment member 41 and the second linear scale 15*b* attached to the second attachment member 51 are different, the phases of the first linear scale 15*a* and the second linear scale 15*b* do not align, and the gantry 4 may tilt relative to the X-axis.

In the present exemplary embodiment, the length adjustment unit 44 and the length adjustment unit 54 are provided to both the first linear scale 15*a* and the second linear scale 15*b*, and thus the length of at least one of the first linear scale 15*a* and the second linear scale 15*b* can be adjusted to align the lengths of the first linear scale 15*a* and the second linear scale 15*b* to each other. This makes it possible to align the phases of the first linear scale 15*a* and the second linear scale 15*b*, and achieve stable movement of the gantry 4.

Note that a configuration in which the length adjustment unit is provided only to one of the first linear scale 15*a* and the second linear scale 15*b* is also possible.

The specific length adjustment of the first linear scale 15*a* and the second linear scale 15*b* can be performed as follows, for example.

First, the position of the gantry 5 in the home position (the position illustrated in FIG. 1) is measured by a high-precision position detection means such as a laser interferometer. The reading of the first linear scale 15*a* by the first encoder 16*a* and the reading of the second linear scale 15*b* by the second encoder 16*b* at this time are zero on both scales.

Next, the gantry 4 is moved in the +Y direction until the displacement of the gantry 4 detected by the laser interferometer is a predetermined distance (1 m, for example). After the movement of the gantry 4, the markings of the first linear scale 15*a* and the second linear scale 15*b* are read by the first encoder 16*a* and the second encoder 16*b*. The length of the first linear scale 15*a* is adjusted by the length adjustment unit 44 and the length of the second linear scale 15*b* is adjusted by the length adjustment unit 54 so that both the reading of the first linear scale 15*a* by the first encoder 16*a* and the reading of the second linear scale 15*b* by the second encoder 16*b* match the displacement of the carriage 5 measured by the laser interferometer.

Note that the phases of the first linear scale 15*a* and the second linear scale 15*b* can be aligned even by making adjustments so that the reading of the first linear scale 15*a* by the first encoder 16*a* and the reading of the second linear scale 15*b* by the second encoder 16*b* match without taking into consideration alignment with the displacement of the carriage 5 measured by the laser interferometer.

Further, in the first attachment member 41 or the second attachment member 51, the moving member 43 or the moving member 53 can also be adjustable in position in the Y-axis direction or the Z-axis direction, for example.

The first frame 18*a* and the second frame 18*b* can be integrally formed with the medium support portion 2, for example. That is, a configuration may be adopted in which the first linear scale 15*a* and the second linear scale 15*b* are provided to the medium support portion 2.

Further, a configuration may be adopted in which two linear scales are provided for the carriage 5.

Electrical Configuration

Figure 3:
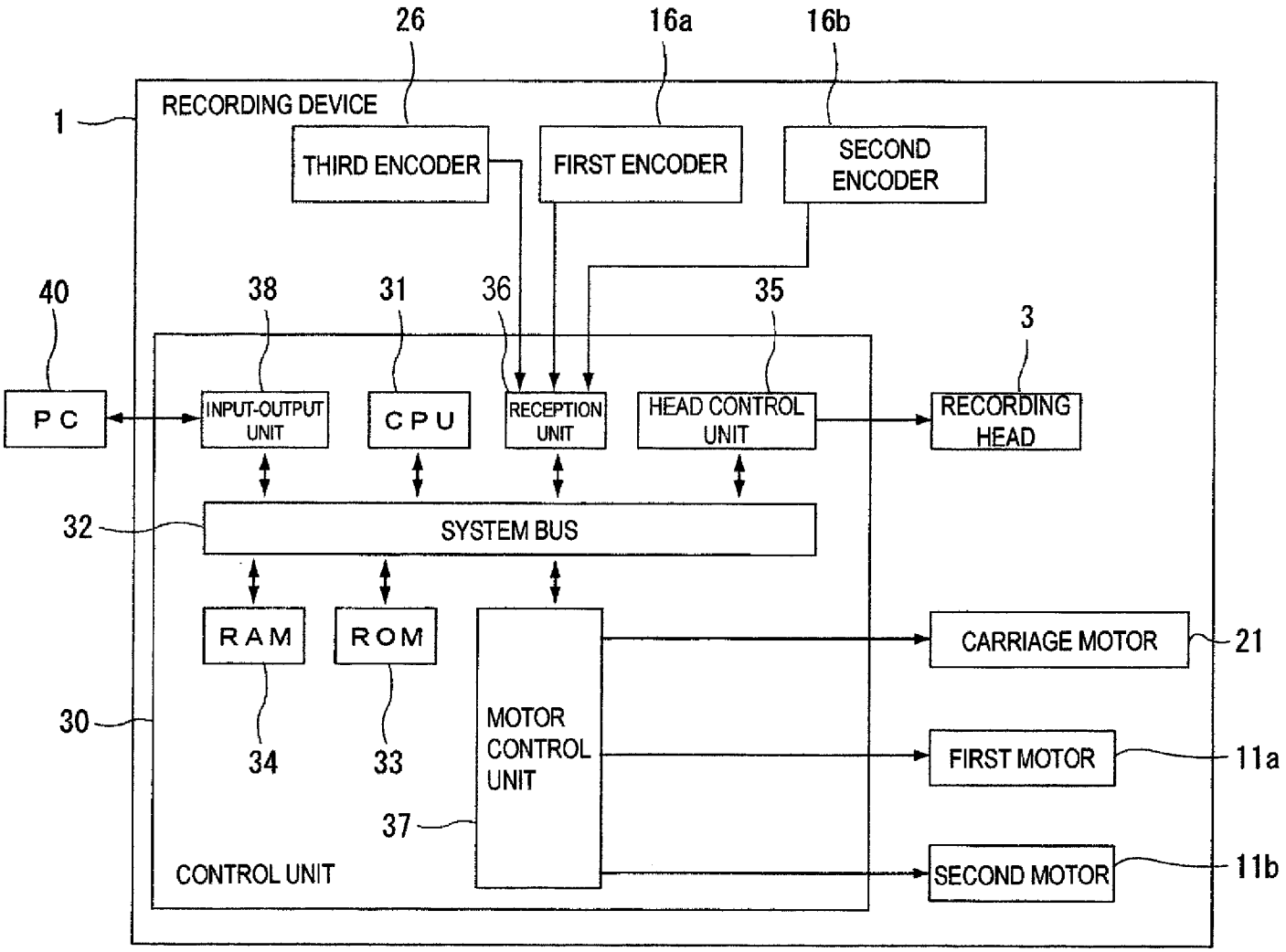
FIG. 3 is a block view illustrating the recording device according to the first exemplary embodiment.

Next, the electrical configuration of the recording device 1 of the present exemplary embodiment will be described using FIG. 3.

The recording device 1 includes the control unit 30 configured to perform various controls in the recording device 1. The control unit 30 is provided with a central processing unit (CPU) 31 that manages control of the recording device 1 in its entirety. The CPU 31 is coupled, via a system bus 32, to a read-only memory (ROM) 33 that stores various types of control programs and the like to be executed by the CPU 31, and a random access memory (RAM) 34 capable of temporarily storing data.

Additionally, the CPU 31 is coupled, via the system bus 32, to a head control unit 35 for performing an ink ejecting operation from the recording head 3.

Further, the CPU 31 is also coupled, via the system bus 32, to a reception unit 36 that receives information with respect to the markings of each linear scale read by the first encoder 16*a*, the second encoder 16*b*, and the third encoder 26, and a motor control unit 37 for driving the first motor 11*a*, the second motor 11*b*, and the carriage motor 21.

Furthermore, the CPU 31 is coupled, via the system bus 32, to an input-output unit 38, and the input-output unit 38 can be coupled to a personal computer (PC) 40, which is a computer for transmitting and receiving data and signals such as recorded data.

While, in the present exemplary embodiment, the recording head 3 is formed as a serial type that records while moving in the X-axis direction, the recording head 3 may be formed as a line head type capable of recording within a maximum width range of the medium while maintaining the position of the recording head 3 in the X-axis direction. That is, a configuration may be adopted in which a line head is provided as an ejecting unit to the gantry 4, and recording is performed while the gantry 4 is moved in the Y-axis direction.

Further, the recording device 1 is not limited to a flatbed type, and a configuration may be adopted in which, for example, the recording device 1 is a serial type that performs recording while moving in the X-axis direction, and recording is performed on the medium P transported to a recording region by the recording head 3.

Note that, when the carriage 5 is the moving unit, the first axial direction is the movement direction of the carriage 5 and is the X-axis direction. Further, at this time, when the Y-axis direction intersecting with the X-axis direction, which is the first axial direction, is the second axial direction, the gantry 4 moves in the length direction extending along the long side of the medium support portion 2 and serving as the second axial direction. The first linear scale 15*a* and the second linear scale 15*b* are second linear scales with markings formed in the second axial direction (Y-axis direction) and having tension applied in a direction along the second axial direction. The second linear scale may be only one of the first linear scale 15*a* and the second linear scale 15*b*. The first encoder 16*a* and the second encoder 16*b* are second detectors that read the corresponding first linear scale 15*a* and the second linear scale 15*b* to detect the displacement of the gantry 4. The length adjustment unit 44 and the length adjustment unit 54 are second length adjustment units that adjust the tensions of the corresponding first linear scale 15*a* and the second linear scale 15*b*, to adjust the lengths of the first linear scale 15*a* and the second linear scale 15*b* in the second axial direction (Y-axis direction).

Further, when the gantry 4 is the moving unit, the first axial direction is the movement direction of the gantry 4 and is the Y-axis direction. Further, at this time, when the X-axis direction intersecting with the Y-axis direction, which is the first axial direction, is the second axial direction, the carriage 5 moves in the width direction extending along the short side of the medium support portion 2 and serving as the second axial direction. The third linear scale 25 is a second linear scale with markings formed in the second axial direction (X-axis direction) and having tension applied in a direction along the second axial direction. Another second linear scale may be provided separately from the third linear scale 25. The third encoder 26 is a second detector that reads the third linear scale 25 to detect a displacement of the carriage 5. The length adjustment unit 64 is a second length adjustment unit that adjusts the tension of the third linear scale 25 to adjust the length of the third linear scale 25 in the second axial direction (X-axis direction).

Note that the present disclosure is not limited to the exemplary embodiments described above, and many variations are possible within the scope of the disclosure as described in the appended claims. It goes without saying that such variations also fall within the scope of the present disclosure.

What is claimed is:

1. A recording device comprising:

a medium support portion configured to support a medium;

an ejecting unit configured to eject a liquid toward a medium supported by the medium support portion;

a moving unit that includes the ejecting unit and is configured to move relative to the medium support portion in a first axial direction;

at least one linear scale provided with markings formed in the first axial direction;

a detector configured to read the markings of the at least one linear scale while moving, together with the moving unit, relative to the medium support portion in the first axial direction to detect a displacement of the moving unit; and a length adjustment unit configured to adjust a length of the linear scale in the first axial direction, by adjusting a tension in the first axial direction applied to the at least one linear scale, wherein the moving unit is a carriage configured to move in a width direction, as the first axial direction, extending along a short side of the medium support portion, wherein when a direction intersecting with the first axial direction is a second axial direction, a gantry is configured to move in a length direction, as the second axial direction, extending along a long side of the medium support portion, at least one second linear scale is provided with markings formed in the second axial direction and having tension applied in a direction along the second axial direction, a second detector configured to read the markings of the at least one second linear scale while moving, together with the gantry, relative to the medium support portion in the second axial direction to detect a displacement of the gantry, and a second length adjustment unit configured to adjust the tension to adjust a length of the at least one second linear scale in the second axial direction.

2. The recording device according to claim 1, comprising:

a fixing member provided fixed in position in the first axial direction; and a moving member provided movable in the first axial direction, wherein the fixing member is attached to a first end portion, the first end portion is one end portion in the first axial direction of the at least one linear scale, the moving member is attached to a second end portion, the second end portion is an end portion opposite to the first end portion in the first axial direction of the at least one linear scale and the length adjustment unit is configured to adjust a position of the moving member in the first axial direction.

3. The recording device according to claim 2, wherein the second end portion is attached to the moving member via an elastic member having elasticity in a direction along the first axial direction.

4. The recording device according to claim 2, wherein at least one of the fixing member and the moving member is adjustable in position in a second axial direction intersecting with the first axial direction.

5. A recording device comprising:

a medium support portion configured to support a medium;

an ejecting unit configured to eject a liquid toward a medium supported by the medium support portion;

a moving unit that includes the ejecting unit and is configured to move relative to the medium support portion in a first axial direction;

at least one linear scale provided with markings formed in the first axial direction;

a detector configured to read the markings of the at least one linear scale while moving, together with the moving unit, relative to the medium support portion in the first axial direction to detect a displacement of the moving unit; and a length adjustment unit configured to adjust a length of the linear scale in the first axial direction, by adjusting a tension in the first axial direction applied to the at least one linear scale, wherein the moving unit is a gantry configured to move in a length direction, as the first axial direction, extending along a long side of the medium support portion, wherein when a direction intersecting with the first axial direction is a second axial direction, a carriage is configured to move in a width direction, as the second axial direction, extending along a short side of the medium support portion, at least one second linear scale provided with markings formed in the second axial direction and having tension applied in a direction along the second axial direction, a second detector is configured to read the markings of the at least one second linear scale while moving, together with the carriage, relative to the medium support portion in the second axial direction to detect a displacement of the carriage, and a second length adjustment unit configured to adjust the tension to adjust a length of the at least one second linear scale in the second axial direction.

6. The recording device according to claim 5, comprising:

a fixing member provided fixed in position in the first axial direction; and a moving member provided movable in the first axial direction, wherein the fixing member is attached to a first end portion, the first end portion is one end portion in the first axial direction of the at least one linear scale, the moving member is attached to a second end portion, the second end portion is an end portion opposite to the first end portion in the first axial direction of the at least one linear scale and the length adjustment unit is configured to adjust a position of the moving member in the first axial direction.

7. The recording device according to claim 6, wherein the second end portion is attached to the moving member via an elastic member having elasticity in a direction along the first axial direction.

8. The recording device according to claim 6, wherein at least one of the fixing member and the moving member is adjustable in position in a second axial direction intersecting with the first axial direction.

* * * * *